US011927014B2

(12) United States Patent
Graziano

(10) Patent No.: US 11,927,014 B2
(45) Date of Patent: Mar. 12, 2024

(54) BITUMINOUS TILE WITH SEALING ENGAGEMENT DEVICES DELIMITING POSITIONING AREAS OF THE ANCHORING NAILS

(71) Applicant: TEGOLA CANADESE SRL, Vittorio Veneto (IT)

(72) Inventor: Peterle Graziano, Alpago (IT)

( * ) Notice: Subject to any disclaimer, the term of this patent is extended or adjusted under 35 U.S.C. 154(b) by 118 days.

(21) Appl. No.: 17/624,995

(22) PCT Filed: Jul. 10, 2019

(86) PCT No.: PCT/IB2019/000571

§ 371 (c)(1),
(2) Date: Jan. 5, 2022

(87) PCT Pub. No.: WO2021/005388

PCT Pub. Date: Jan. 14, 2021

(65) Prior Publication Data

US 2022/0282486 A1 Sep. 8, 2022

(51) Int. Cl.
*E04D 1/26* (2006.01)
*E04D 1/00* (2006.01)
(Continued)

(52) U.S. Cl.
CPC ..... *E04D 1/26* (2013.01); *E04D 1/20* (2013.01); *E04D 1/28* (2013.01); *E04D 1/29* (2019.08);
(Continued)

(58) Field of Classification Search
CPC ..... E04D 1/29; E04D 2001/3455; E04D 1/26; E04D 1/20; E04D 1/28; E04D 2001/3423; E04D 2001/3435
See application file for complete search history.

(56) References Cited

U.S. PATENT DOCUMENTS 5,950,387 A * 9/1999 Stahl ..... E04D 1/29 52/748.1
7,204,063 B2 * 4/2007 Kandalgaonkar ..... E04D 1/2918 52/551
(Continued)

OTHER PUBLICATIONS

International Search Report for corresponding PCT/IB2019/000571, dated Feb. 3, 2020.
(Continued)

*Primary Examiner* — Adriana Figueroa
(74) *Attorney, Agent, or Firm* — Egbert, McDaniel & Swartz, PLLC

(57) ABSTRACT

Bituminous tile with sealing engagement devices delimiting positioning areas of the anchoring nails including a tile body of the layered type and provided with shaped flaps delimited by separation cuts, wherein the upper face of the tile body is provided with a plurality of sealing engagement devices which are made in such a way as to have an immediately identifiable nailing area which is perimetrically delimited by a sealing engagement area that is made of an adhesive and/or thermally adhesive and/or hot melt material. The sealing engagement area enables the bonding engagement of the corresponding flap of the bituminous tile that in a laid condition is thereby overlapped, also enables a perfect sealing of the insertion area of the anchoring nail.

8 Claims, 5 Drawing Sheets

(51) Int. Cl.
*E04D 1/20* (2006.01)
*E04D 1/28* (2006.01)
*E04D 1/34* (2006.01)

(52) U.S. Cl.
CPC ..... *E04D 2001/3423* (2013.01); *E04D 2001/3435* (2013.01); *E04D 2001/3455* (2013.01); *E04D 2001/3491* (2013.01)

(56) References Cited

U.S. PATENT DOCUMENTS

| | | | | |
|---|---|---|---|---|
| 8,307,599 | B2 | 11/2012 | Jenkins et al. | |
| 10,947,729 | B2 * | 3/2021 | Collins | B32B 7/12 |
| 2004/0148874 | A1 | 8/2004 | Jolitz et al. | |
| 2010/0196647 | A1 * | 8/2010 | Bryson | E04D 1/20 52/309.3 |
| 2012/0291389 | A1 | 11/2012 | Jenkins et al. | |
| 2012/0297716 | A1 | 11/2012 | Kalkanoglu et al. | |
| 2015/0093551 | A1 | 4/2015 | Martin et al. | |

OTHER PUBLICATIONS

Written Opinion of the International Searching Authority for corresponding PCT/IB2019/000571, dated Feb. 3, 2020.

* cited by examiner

BITUMINOUS TILE WITH SEALING ENGAGEMENT DEVICES DELIMITING POSITIONING AREAS OF THE ANCHORING NAILS

The present invention relates to a bituminous tile with sealing engagement devices delimiting positioning areas of the anchoring nails.

The invention finds particular but not exclusive application in the sector of the industry of production and marketing of bituminous tiles and more widely in the industry of production and marketing of elements for covering buildings as well as, more broadly speaking, in the industry of production and marketing of products for the building sector.

Buildings in general as well as the structures intended for covering a delimited space are in most cases made in such a way as to be provided with a covering surface intended to cooperate with the remaining structure for the purpose of sheltering the delimited interior spaces from adverse weather conditions, in particular from rainwater. In order to enable said protection function inside buildings, in most cases, the structuring thereof provides the creation of a covering structure that defines the upper part of the building, wherein said covering structure, commonly known as roof, is essentially made up of a load-bearing structure and of an actual covering structure defined as roof covering. Properly the roof covering is the actual coating of the surface of the structure of the roof that ensures that the interiors are protected from the weather, in particular from the penetration of rainwater. In a first generalization, the coverings can be distinguished into different kinds among which one can mainly mention the coverings of the continuous type, in which the roof covering is made by using large elements that are laid next to one another in such a way as to ensure their sealing independently of the roof slope, and the coverings of the non-continuous type in which the roof covering is made by connecting different component units, which are associated with each other in such a way as to enable, also thanks to the exploitation of the roof slope, to make the roof in which they are anchored watertight by allowing rainwater to flow and preventing infiltrations. Independently of whether the roofs are of the flat or pitched type, the types of roof covering can be different as well, providing different types of coating elements among which of traditional use are those of brick or stone materials. In addition to the use of traditional stone or brick materials for making roof coverings, as specifically disclosed in the present invention, it is also known to use bituminous tiles that are suitable to make up an optimal cover also in conditions of considerable inclination of the pitches or for flat roofs. With particular reference to bituminous tiles, at present they are still made by assembling layers of different materials of which at least one layer of glass fibre that is impregnated with some layers of bitumen that ensure its watertightness and resistance to temperature excursions also providing its necessary dimensional stability. When making the bituminous tiles, moreover, their upper surface is usually made by means of the covering with a layer of ceramic-coated granules mainly having a function of protection of the bitumen layers from the action of degradation from ultraviolet radiation and also for the purpose of providing the tile with a uniform, shaded or mixed colour depending on the specific colour of the granules, a colour that is provided by means of a ultra-high temperature ceramic coating process with inorganic pigments in order to ensure the necessary stability of the colour created. Some known variants of bituminous tiles also provide that, as an alternative to a surface layer of ceramic-coated granules, there can be a sheet metal layer. Furthermore, solutions of bituminous tiles are also known, which, for the purpose of facilitating their laying, are provided with adhesive or bituminized areas usually arranged along the anchoring line of the tiles, said areas being colloquially referred to as "adhesive patches".

The peculiar characteristics of the bituminous tiles mainly consist of the guarantee of excellent protection from the weather, with particular reference to watertightness, combined with a considerable reduction in weights with respect to the solutions of traditional tiles made of brick or stone materials, it is also advantageous that their structure also provides, in addition to the maintenance of the flexibility of the material, the possibility of remarkable industrialization variants allowing to set up roof coverings in roofs having a different architecture. Although in the different types of bituminous tiles that can be made, known and widespread are the bituminous tiles made in such a way as to be shaped including a part consisting of reciprocally separate contiguous flaps which, in variants of the known and widespread type, are rectangular or include a rounding or a triangle configuration at the lower end of each flap. Consequently to the characteristics of said bituminous tiles, the laying method, too, which is necessary for making the roof covering, is affected by the specific features thereof and, obviously, of the roof support on which the bituminous tiles will be applied. In short, the application of the bituminous tiles to form the roof covering is conceived in such a way that the laying plane of the roof must consist of a continuous and coplanar foundation, the laying being able to be carried out on different types of support of the pitch, said supports being able to be indifferently made for example of concrete, of concrete and masonry, of wooden boards, of plywood, of OSB or of sheet metal.

Due to the same structure of the bituminous tiles, the laying plane should be nailable because, in order to anchor the bituminous tiles, anchoring nails are required, which are usually of the wide head type having a length suitable for the thickness and type of foundation. If the surface of the laying plane is not of the nailable type, for example because it is made of concrete or concrete and masonry, the positioning and the anchorage of the bituminous tiles occur by using a bituminous sheath that also acts as an anchoring substrate between the laying plane and the bituminous tile. In case of use of the bituminous sheath, the latter must be applied, in a known way depending on the type, in complete adhesion on the laying plane, wherein each tile is torch applied by means of the heating up to a suitable degree of softening of the elastoplastomeric components of the bituminous sheath in correspondence of the lower part of the anchoring zone of the tile. As far as in particular the traditional laying method is concerned, it is conceived in such a way that the tiles must be arranged in parallel rows in which the tiles are arranged in partial overlapping. Owing to the need that the rows of bituminous tiles are arranged in such a way that the bituminous tiles that make up the following row partially overlap the bituminous tiles forming the previous row, the latter row being underlying with respect to said following row, due to the structure of the bituminous tiles themselves, their positioning with respect to one another must be characterized by anchoring homogeneity so that the nailing line is necessarily included in a limited area because the fixing of the underlying bituminous tile is carried out in the vicinity of the longitudinal end thereof. Considering the above, the importance of a nailing procedure complying with a criterion of close positioning of the nail on the bituminous tile to prevent the non-anchoring of the underlying bituminous tile is clear, it being just as evident that it is necessary to protect the insertion area of the anchoring nail and the anchoring nail itself from the possibility of infiltrations that may cause an early degradation of the tile and of the anchoring nail.

PRIOR ART

In the currently available patent literature some solutions of tiles are known in which the positioning of the nail is somehow simplified and packed.

Among the found solutions, for example, we would like to mention the following:

D1: US2004/0148874 (Jolitz et al.)

D2: US2012/0297716 (Kalkanoglu et al.)

D3: U.S. Pat. No. 8,307,599 (Jenkins et al.)

D1 synthetically describes a solution relating to covering elements for making a roof covering in which the covering elements of the roof covering must be of such a type as to be arranged to form longitudinal laying lines, wherein said covering element can be of the type consisting of one of the currently known covering elements for roofs. The covering element according to the solution can be of the shaped type, for example in the form of a slate tile, or can be of the type made in any other known covering element including the traditional bituminous tiles, said covering element comprising a front surface and a laying line placed in an intermediate and suitably oriented position, said covering element being further provided with definite nailing zones on the front surface, wherein the laying line can be at the centre of the front surface or shifted from said centre.

D2 synthetically describes a polymer based synthetic tile of the rigid type provided with nailing zones made in such a way as to be relatively flexible within the elastic limits of the material they are made of, wherein said nailing zones assist in the relief of the mechanical stress induced by nailing at said fastening zones, the material used for said nailing zones being of the elastic type. Said nailing zones made in such a way as to comprise at least one part of elastically deformable material allow to effectively dissipate forces of thermal expansion and contraction that develop in the nail zone. Said nailing zones enable both traditional hand-nailing applications and installations with nail-guns.

D3 synthetically describes a moulded synthetic polymer based shingle and a roof made up of underlying and overlying courses of such shingles, wherein the shingles according to this solution are rigid and are provided with a head part and with a edge, wherein the head part is provided with at least two moisture guards that are made in such a way as to be protruding from the upper portion of the head part of the shingle, which upper portion of the head part of the shingle, once positioned, is overlapped by the lower surface of the lower edge and by part of the lower surface of the head part of the shingle. The moisture guards with which the shingle is provided are made so as to consist of a perimetric wall inside whose area the anchoring nail is inserted, in such a way that its head is protected by said moisture guards that cooperate with the lower surface of the edge of the shingle so that the latter, by fully covering the top of said guards, enables its sealing and prevents moisture from getting in.

Drawbacks

All the known solutions of tiles for making the roof covering of buildings as in the known prior art have, although to a different extent, some defects or limits.

A first limit involving all the solutions of tiles for making roof coverings for buildings, according to the applicant, lies in the fact that said solutions are optimized in terms of maintaining in time the integrity of the insertion zone of the anchoring nail against the possibility that said insertion zone itself and the anchoring nail that is inserted therein may be affected by moisture infiltrations that may jeopardize the optimal sealing of the tile in case the latter is of the bituminous type.

A second limit involving all the solutions of tiles for making roof coverings for buildings as in the found prior art documents, according to the applicant, lies in the fact that none of said solutions allows to simultaneously provide both the sealing of the insertion area of the anchoring nail and to ensure optimal adhesion, by means of the bonding engagement of the flaps of the overlying tile to the underlying tile when they are in a laid condition.

A third limit involving all the solutions of tiles for making roof coverings for buildings as in the found prior art documents, according to the applicant, lies in the fact that said solutions do not allow to accurately identify the optimal nailing area and to simultaneously ensure the sealing and the watertightness of the insertion area of the anchoring nail that may be achieved by means of the bonding engagement of the tiles that are overlapped in a laid condition.

Another limit involving all the solutions of tiles for making roof coverings for buildings as in the found prior art documents, according to the applicant, lies in the fact that said solutions do not prevent the persons in charge of laying from making nailing mistakes during the laying of the tiles.

An additional limit involving all the solutions of tiles for making roof coverings for buildings as in the found prior art documents, according to the applicant, lies in the fact that said solutions do not allow to reduce laying times and do not allow to reduce the need for maintenance interventions after laying.

Therefore, there is the need for the companies of the sector to find some optimal solutions for achieving the following aims.

ABSTRACT OF THE OBJECT OF THE INVENTION

These and other aims are achieved by the present invention according to the characteristics as in the appended claims by solving the mentioned problems by means of a bituminous tile (1) with sealing engagement devices delimiting positioning areas of the anchoring nails comprising a tile body (2) of the layered type and provided with shaped flaps (3) delimited by separation cuts (4) wherein the upper face (21) of the tile body (2) is provided with a plurality of sealing engagement devices (5) which are made in such a way as to comprise an immediately identifiable nailing area (51), which is perimetrically delimited by a sealing engagement area (52) which is made of an adhesive and/or thermally adhesive and/or hot melt material and wherein said sealing engagement area (52), enabling the bonding engagement of the corresponding flap (3) of the bituminous tile that in a laid condition is thereby overlapped, also enables a perfect sealing of the insertion area of the anchoring nail.

Aims

By the considerable creative contribution the effect of which constitutes an immediate technical progress various aims and advantages are achieved.

A first advantageous aim of the present invention is to obtain a bituminous tile with sealing engagement devices delimiting positioning areas of the anchoring nails through whose innovative structure it is possible, thanks to the arrangement of innovative sealing engagement devices, to ensure the watertightness and consequently the optimal preservation of the integrity of the insertion zone of the anchoring nail against the possibility that said insertion zone itself and the anchoring nail that is inserted therein may be affected by moisture infiltrations, thus ensuring the optimal sealing of the bituminous tile.

A second advantageous aim of the present invention is to obtain a bituminous tile with sealing engagement devices delimiting positioning areas of the anchoring nails through which it is possible, due to the particular structure of the bituminous tile that is provided with sealing engagement devices, to simultaneously enable both the sealing of the insertion area of the anchoring nail and to ensure the optimal adhesion, by means of a bonding engagement, of the flaps of the overlying tile to the underlying tile when they are in a laid condition.

A third advantageous aim of the bituminous tile with sealing engagement devices delimiting positioning areas of the anchoring nails according to the present invention consists, particularly thanks to the innovative arrangement of sealing engagement devices, of the possibility to enable an accurate identification of the optimal nailing area and to simultaneously ensure the sealing and the watertightness of the insertion area of the anchoring nail that may be achieved by means of the bonding engagement of the tiles that are overlapped in a laid condition.

Another advantageous aim of the bituminous tile with sealing engagement devices delimiting positioning areas of the anchoring nails according to the present invention consists, particularly thanks to the innovative arrangement of sealing engagement devices, in preventing the persons in charge of laying from making nailing mistakes during the laying of the tiles, thus ensuring that the nailing carried out on the overlying bituminous tile also correctly engages the underlying bituminous tile.

A further advantageous aim of the bituminous tile with sealing engagement devices delimiting positioning areas of the anchoring nails according to the present invention consists, particularly thanks to the innovative arrangement of sealing engagement devices, in reducing laying times and the need for maintenance interventions after laying, thus enabling a remarkable reduction in the costs related to the laying and maintenance of the roof covering.

Another advantageous aim of the bituminous tile with sealing engagement devices delimiting positioning areas of the anchoring nails according to the present invention, particularly thanks to the innovative arrangement of sealing engagement devices placed in correspondence of a zone above the separation cuts of the flaps, consists in obtaining an optimal aesthetic effect of the whole cover made so that the sealing engagement devices of the underlying bituminous tiles are not visible through the separation cuts of the flaps.

These and other advantages will appear from the following detailed description of some preferred embodiments whose details of execution are not to be considered as limiting.

CONTENT OF THE DRAWINGS

PRACTICAL REALIZATION OF THE INVENTION

Referring without limits also to the content of the drawings as from the representations as in FIGS. 1 to 7, a bituminous tile (1) with sealing engagement devices delimiting positioning areas of the anchoring nails is described, which is intended to be used in the making of roof coverings for buildings, said bituminous tile (1), in the described example, which is to be considered as a preferred embodiment, consists of a tile body (2) made in a known way, preferably layered, such as to be made up of materials that are known in the making of the current bituminous tiles. In the described exemplary embodiment of the solution according to the present invention, in a preferable and not limiting way, the tile body (2) consists of a composite obtained from the combination of multiple bonded component layers of which, as it is currently known, at least one intermediate supporting layer that is of the known type and is made of glass fibre or of polyester and glass veil pre-impregnated with bitumen, in any case the supporting layer being able to be made also with other known fibres which are suitable for use in making an intermediate supporting layer intended to be used in the making of bituminous tiles, said fibres constituting the intermediate supporting layer being preferably and in a known way pre-impregnated with bitumen. In addition to said intermediate supporting layer, the tile body (2) is made in such a way as to comprise, coupled with the intermediate layer, at least two bitumen layers of which an upper layer and a lower layer in such a way that said intermediate layer is interposed between said bitumen layers, the latter being usually and preferably made with bitumen of the known type suitable for the intended purpose of constituting a bituminous tile. Furthermore, as it is known, the tile body (2) is of the type preferably comprising at least one upper covering layer consisting of ceramic-coated granules that can be coloured, it being also provided that, opposite said upper covering layer, the tile body (2) is provided with at least one lower layer of the known type, in the described exemplary embodiment and in a non-limiting way said lower layer being of silica sand, although said lower layer can also be of a different known type.

Figure 1:
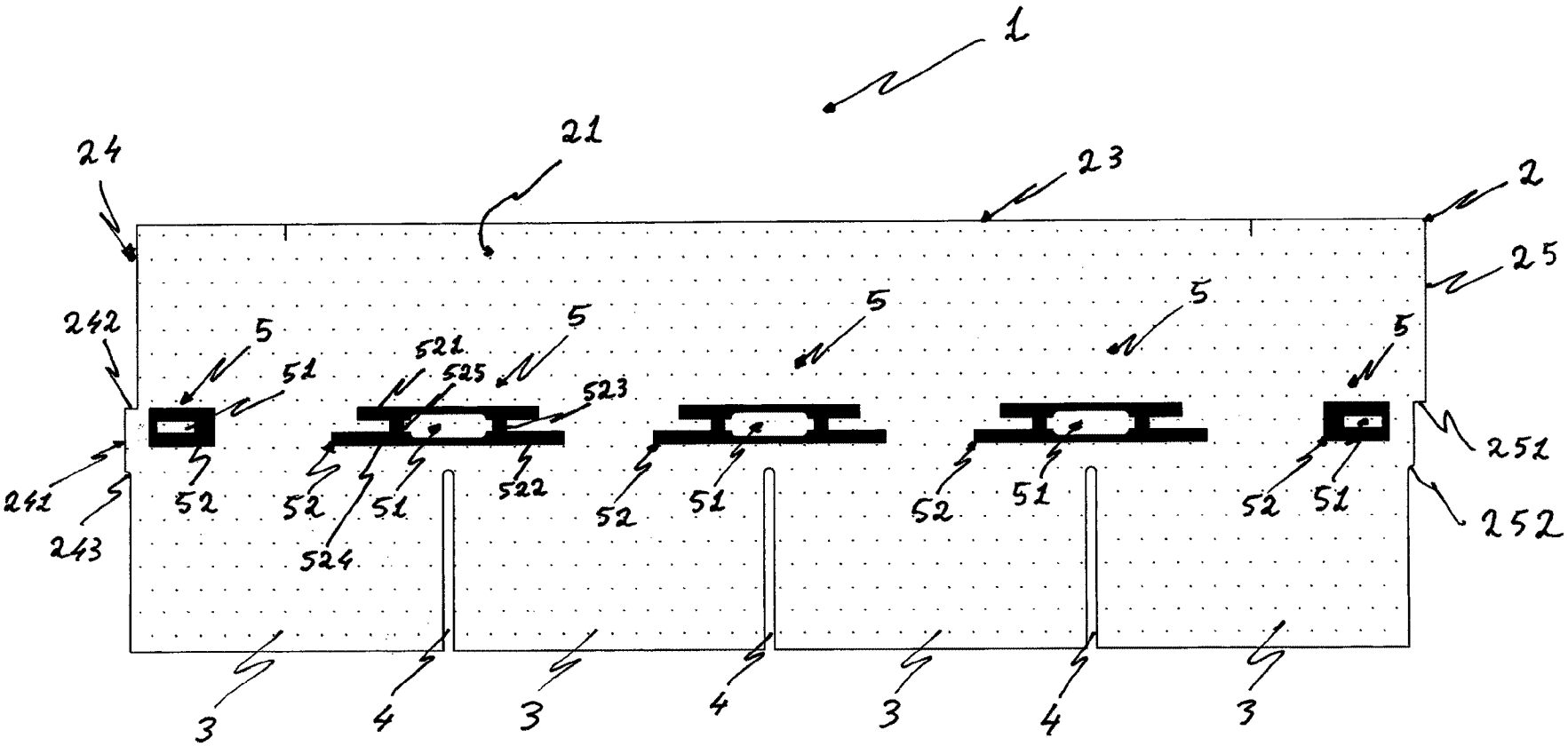
FIG. 1 is a plan view from above of the bituminous tile with sealing engagement devices delimiting positioning areas of the anchoring nails according to the present invention in the version with quadrangular flaps.
Figure 2:
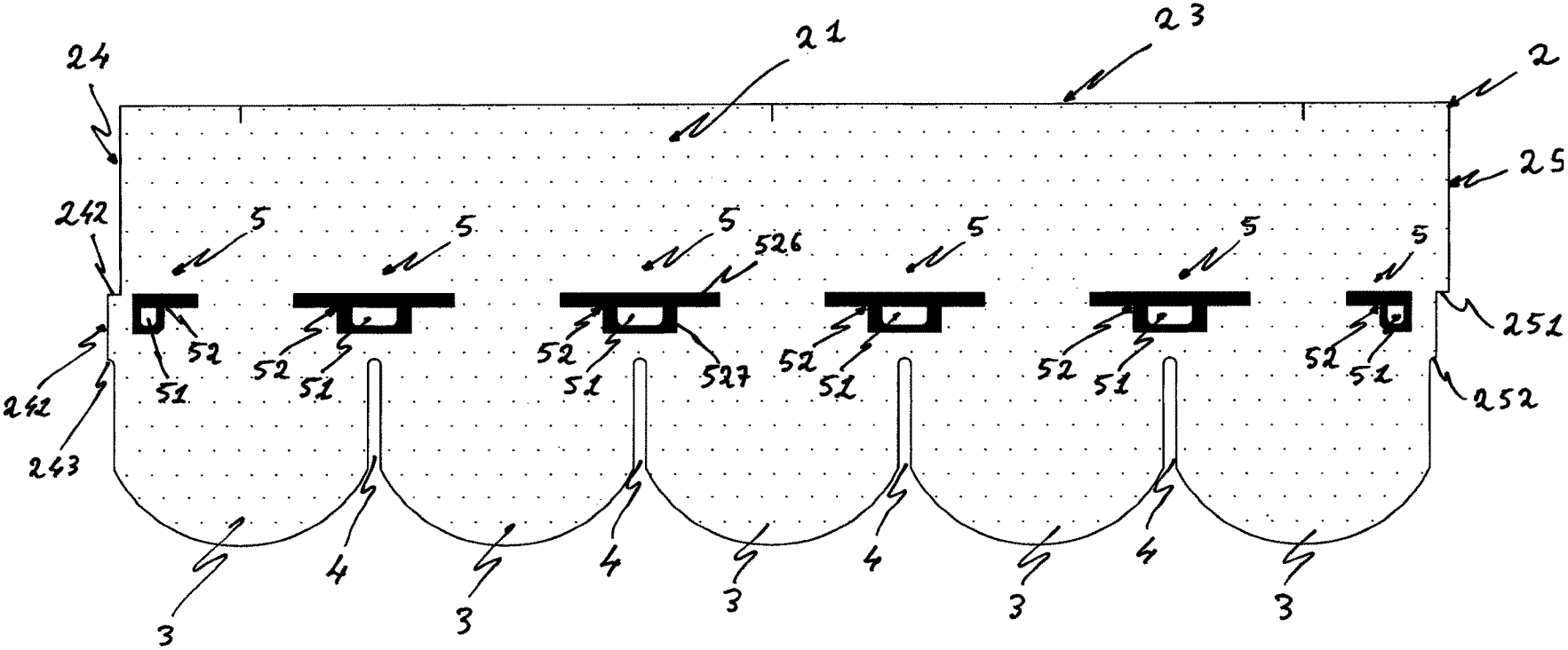
FIG. 2 is a plan view from above of the bituminous tile with sealing engagement devices delimiting positioning areas of the anchoring nails according to the present invention in the version with arched "fish scale" flaps.
Figure 3:
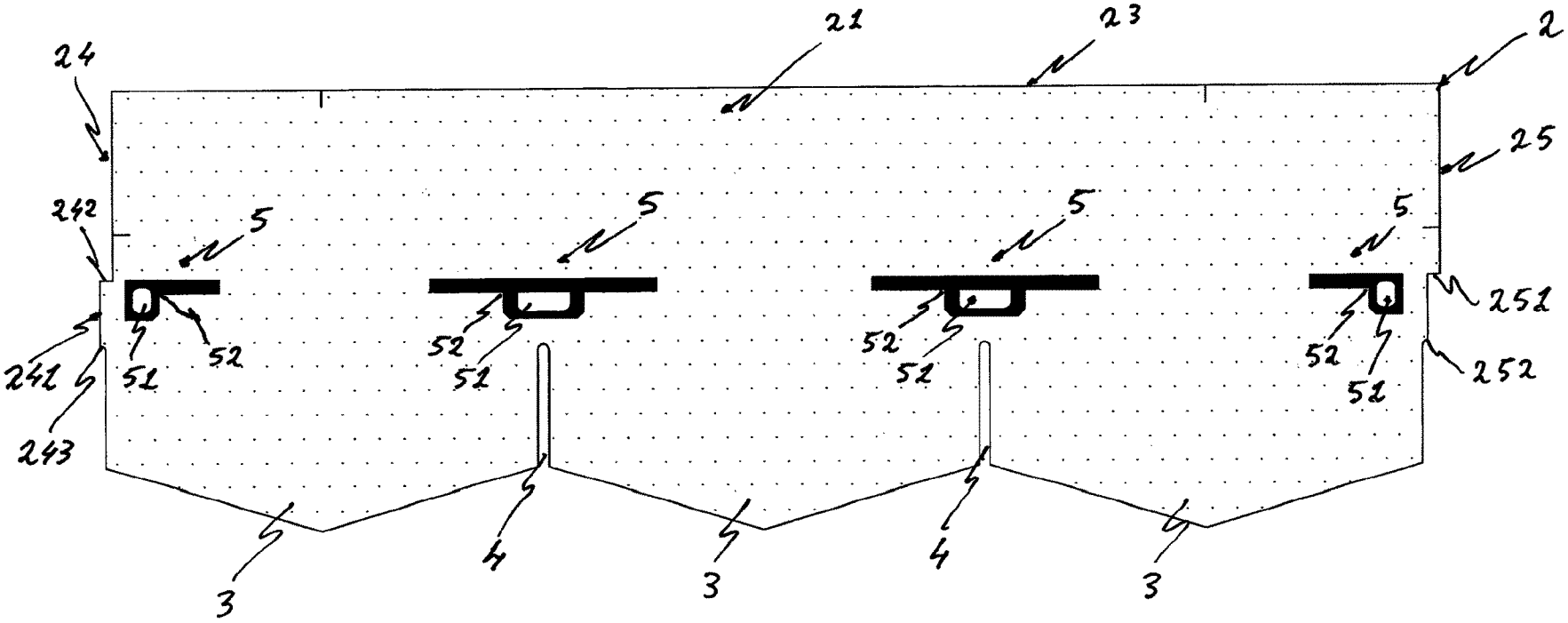
FIG. 3 is a plan view from above of the bituminous tile with sealing engagement devices delimiting positioning areas of the anchoring nails according to the present invention in the version with triangular ending flaps.
Figure 4:
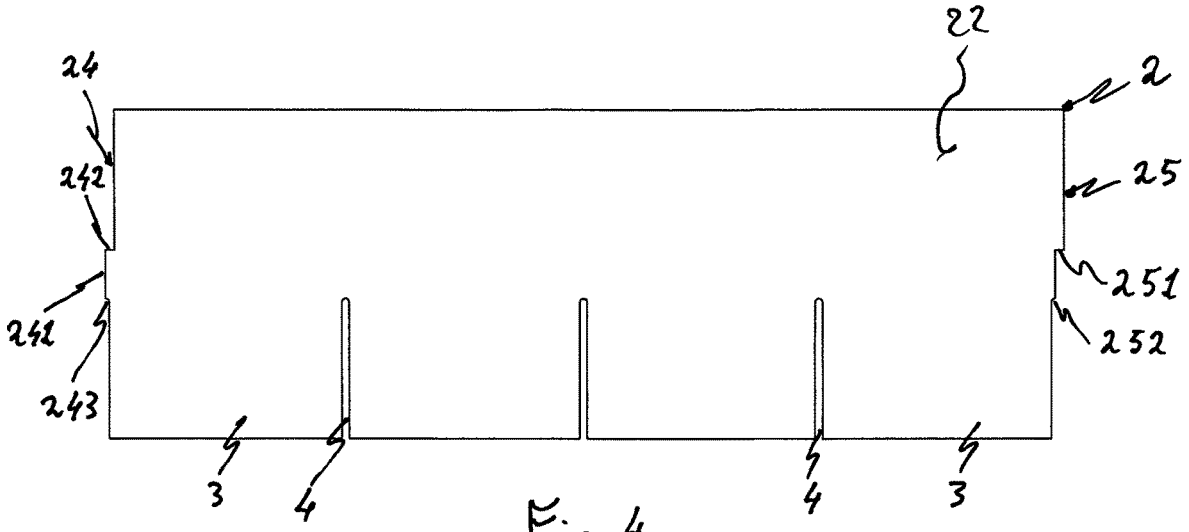
FIG. 4 is a plan view from below of the bituminous tile with sealing engagement devices delimiting positioning areas of the anchoring nails according to the present invention in the version with quadrangular flaps.
Figure 5:
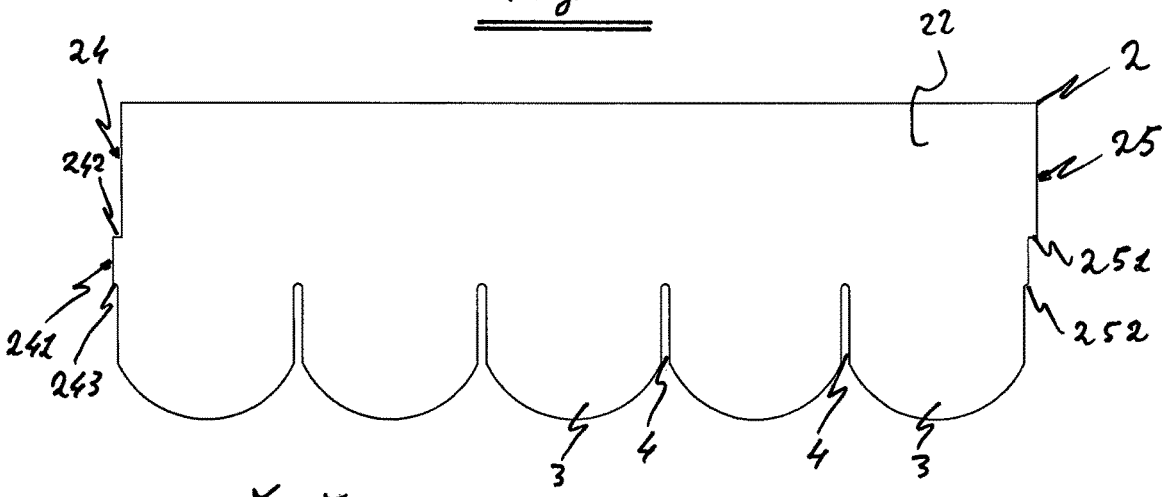
FIG. 5 is a plan view from below of the bituminous tile with sealing engagement devices delimiting positioning areas of the anchoring nails according to the present invention in the version with arched "fish scale" flaps.
Figure 6:
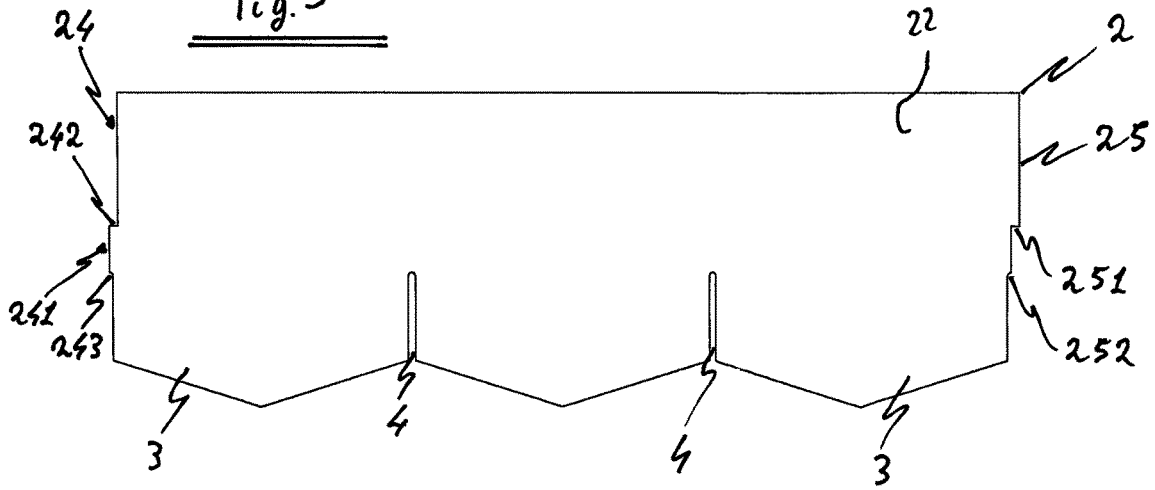
FIG. 6 is a plan view from below of the bituminous tile with sealing engagement devices delimiting positioning areas of the anchoring nails according to the present invention in the version with triangular ending flaps.

In this way, as from the representation as in FIG. 1, FIG. 2 and FIG. 3, the tile body (2) realizes a sheet-like plate that comprises an upper face (21) and a lower face (22), wherein the lower face is opposite the upper face (21), wherein the upper face (21) in a laid condition is intended to be facing upwards while the lower face (22) of the bituminous tile (1) in a laid condition, in a known way, is intended to at least partially rest on the laying foundation of the roof to be covered. In the described exemplary embodiment the tile body (2) comprises a series of flaps (3) arranged in an aligned sequence after one another in correspondence of the lower longitudinal portion of the tile body (2) itself, wherein the flaps (3) are made in such a way that each of them is identically shaped with respect to the others. In the tile body (2) one flap (3) and the adjacent one are separate by means of a separation cut (4) that is made in the tile body (2) between one flap (3) and the adjacent one, it being provided that, in the described example, the separation cuts (4) are parallel to each other and of identical shape and size, thus being orthogonal with respect to the upper longitudinal side (23) of the tile body (2). In this way, the separation cuts (4) define the development in height of the flap (3) to which they are related. In more detail as to the described exemplary embodiment, each flap (3) as in the example shown in FIG. 1 is rectangular, while the shape of each flap (3) as in the representation of FIG. 2 is provided with an arched lower portion assuming a shape that is conventionally defined as "fish scale". Furthermore, in the bituminous tile (1) as in the example shown in FIG. 3, the terminal part of the flap (3) is shaped in such a way as to assume a triangular shape. The flaps (3) with which the tile body (2) is provided can indifferently be of a different shape and size with respect to those depicted in FIG. 1, FIG. 2 and FIG. 3, wherein said flaps (3) can be of a known shape or of a shape specifically made to comply with contingent application requirements.

As it is shown in FIGS. 1 to 3, the tile body (2), in the described exemplary embodiment, is made in such a way that both the left side (24) and the right side (25) are shaped in a known way. In more detail, although the left side (24) and the right side (25) of the tile body (2) can be shaped in any way that may be deemed useful in relation to the intended purpose of the bituminous tile (1), in the described exemplary embodiment, as it is particularly shown in FIGS. 1 to 3, the left side (24) of the tile body (2) comprises a reference protrusion (241), wherein said reference protrusion (241) is made in such a way as to comprise an upper wall (242) and a lower wall (243) which are parallel to each other. Furthermore, the right side (25) of the tile body (2), in the exemplary embodiment as in FIGS. 1 to 3, is shaped in such a way as to realize a series of recesses so as to create a first reference wall (251) and a second reference wall (252). In detail, the first reference wall (251) of the right side (25) of the tile body (2) is on the same axis as the upper wall (242) of the reference protrusion (241) of the left side (24) of the tile body (2), while the second reference wall (252) of the right side (25) of the tile body (2) is on the same axis as the lower wall (243) of the reference protrusion (241) of the left side (24) of the tile body (2). The assembly consisting of the upper wall (242) and of the lower wall (243) of the reference protrusion (241) of the left side (24) of the tile body (2) and of the first reference wall (251) and of the second reference wall of the right side (25) of the tile body (2) allows to realize a system of reference indices that allow to simplify the relative positioning of each bituminous tile (1) with respect to the adjacent one and, as shown for example in FIG. 7, with respect to the bituminous tile (1) that in a laid condition is underlying in order to carry out a correct alignment and a correct overlapping thereof for laying. As it is known, the area between the upper wall (242), the lower wall (243), the first reference wall (251) and the second reference wall (252) defines an engagement strip, within which the nailing of a bituminous tile (1) is to be carried out.

Figure 7:
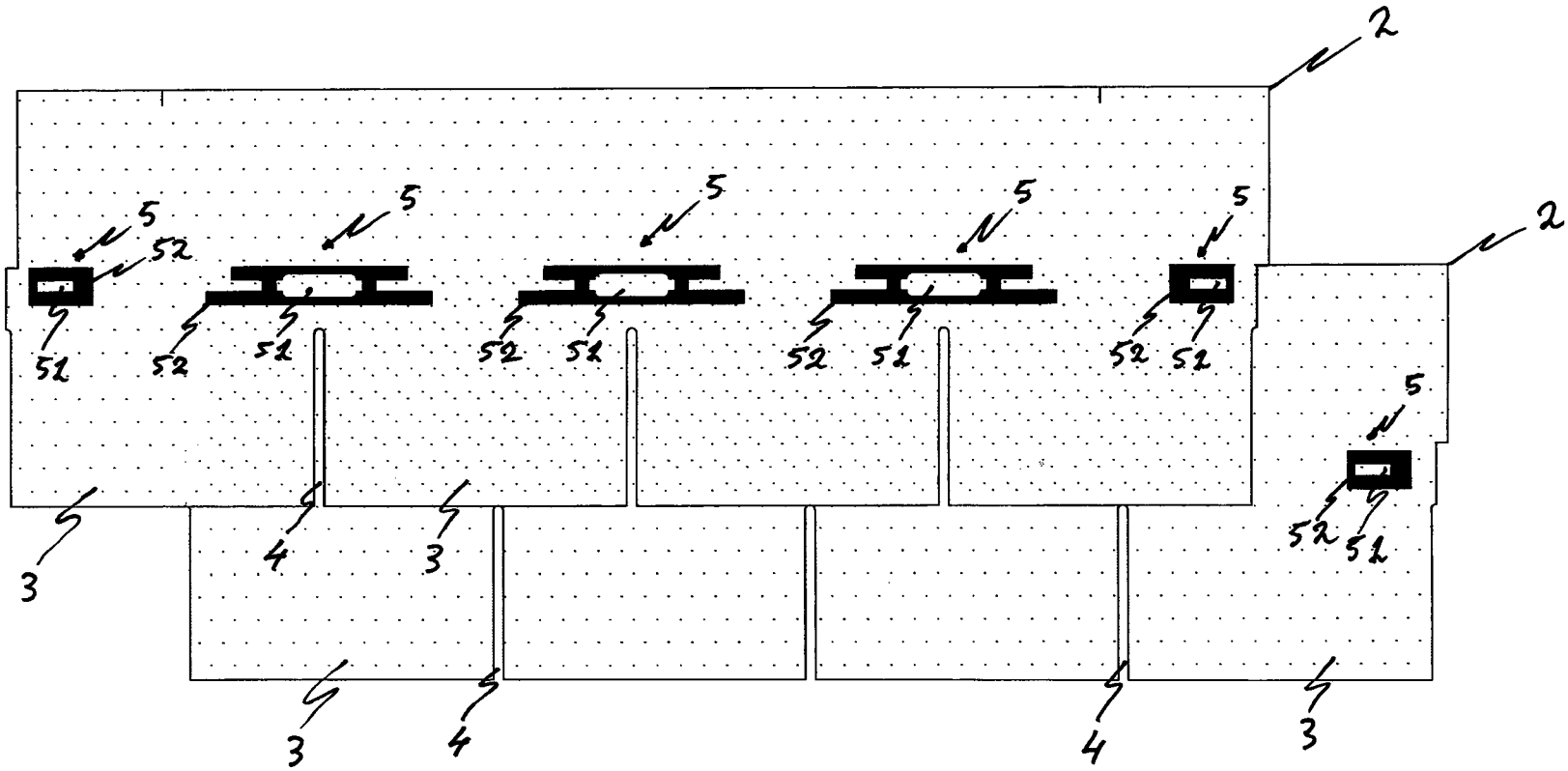
FIG. 7 is a view of two bituminous tiles with sealing engagement devices delimiting positioning areas of the anchoring nails according to the present invention shown in a laid condition.

As an innovation, the tile body (2) of the bituminous tile (1) according to the present invention, at least in correspondence of the upper face (21) is provided with sealing engagement devices (5) which are made of an adhesive and/or thermally adhesive and/or hot melt material, preferably adhesive bitumen and, as shown for example in FIG. 7, they are made for the purpose of simultaneously obtaining, in a laid condition, both the bonding engagement of the sealing engagement device (5) of the underlying bituminous tile (1) to at least one portion of the overlying bituminous tile (1), and the sealing of the insertion zone of the anchoring nail whose positioning must be within the sealing engagement device (5). In more detail, as shown in the exemplary embodiments as in FIGS. 1 to 3, said sealing engagement devices (5) are made in such a way as to consist of circumscribed areas of adhesive and/or thermally adhesive and/or hot melt material so that each sealing engagement device (5) is made in such a way as to form on the tile body (2) a circumscribed area whose shape can be different or constant for each sealing engagement device (5) with which the tile body (2) is provided. In more detail as to the solution according to the invention, each sealing engagement device (5) comprises a nailing area (51) delimited and circumscribed by a sealing engagement area (52), the latter being made of an adhesive and/or thermally adhesive and/or hot melt material, wherein the nailing area (51) is preferably devoid of the adhesive and/or thermally adhesive and/or hot melt material of which the sealing engagement area (52) of the sealing engagement device (5) is made. In order to ensure the optimal sealing of the nailing area (51) so as to protect both the integrity of the area of the tile body (2) surrounding the insertion area of the anchoring nail by making it watertight and the integrity of the anchoring nail that is inserted therein, the sealing engagement area (52) of the sealing engagement device (5) is suitably sized to enable both the sealing of at least the head of the anchoring nail inserted in the nailing area (51) and, as shown for example in FIG. 7, to allow the sealing engagement area (52) of the sealing engagement device (5) to be bondingly engaged with the overlying bituminous tile (1). In more detail as to the present invention, the sealing engagement area (52) of the sealing engagement device (5) can also be at least partly protruding with respect to the plane on which the nailing area (51) lies, which coincides with the plane of the upper face (21) of the tile body (2). Preferably, although not necessarily, the sealing engagement area (52) is made in such a way as to be protruding with respect to the nailing area (51) thus having such a thickness as to compensate at least for the thickness of the head of the anchoring nail when the latter is inserted on the nailing area (51) of the sealing engagement device (5). As an alternative, it is also possible that the thickness of the head of the anchoring nail being inserted on the nailing area (51) of the sealing engagement device (5) is compensated for by means of the proper sizing of the sealing engagement area (52) which should be such as to compensate for any deformations induced on the tile body (2) by the head of the anchoring nail in an inserted condition in order to allow, in any case, that in a laid condition the bonding engagement of the sealing engagement area (52) of the sealing engagement device (5) with the overlying bituminous tile (1) enables the sealing of the nailing area (51) and of the head of the inserted anchoring nail.

In a possible variant of the invention the sealing engagement device (5) is made in such a way that the adhesive and/or thermally adhesive and/or hot melt material involves both the sealing engagement area (52) and at least partially the nailing area (51). In a further possible variant, in order to make the nailing area (51) evident, the colour of the nailing area (51) itself is different from the colour of the sealing engagement area (52). As it is particularly shown in the examples as in FIGS. 1 to 3, the positioning of the sealing engagement devices (5) is such that they are arranged parallel to each other along the same line, wherein each sealing engagement device (5) is preferably equidistant from the adjacent one, said sealing (51) of the sealing engagement device (5) is preferably smaller than the size of the sealing engagement area (52). In the example of FIG. 1 the shape of the sealing engagement area (52) of the sealing engagement devices (5) that are placed above the separation cuts (4) is such as to comprise a first horizontal band (521) and a second horizontal band (522), parallel to each other, and wherein the first horizontal band (521) is shorter than the second horizontal band (522), wherein said horizontal bands (521, 522) are joined by two reciprocally parallel vertical bands (523, 524), wherein the nailing area (51) is included between said horizontal (521, 522) and vertical bands (523, 524) and is of an ideally rectangular shape with hollows (525) in an intermediate position and bevelled corners. Furthermore, in the example of FIG. 1, the sealing engagement devices (5) that are placed in the vicinity of the left side (24) and of the right side (25) of the tile body (2) respectively are made in such a way that the sealing engagement area (52) is essentially shaped as a rectangular perimeter, wherein the shape of the nailing area (51) is rectangular as well. In the example of FIG. 2 and of FIG. 3, the sealing engagement devices (5) are made in such a way that the shape of those that are placed above the separation cuts (4) is such that the contour of the sealing engagement area (52) comprises an upper horizontal band (526) below which and joined to which there is a "U" wall (527), wherein the nailing area (51) is rectangular. Furthermore, in the example of FIG. 2 and of FIG. 3, the sealing engagement devices (5) that are placed in the vicinity of the left side (24) and of the right side (25) of the tile body (2) respectively are made in such a way that the sealing engagement area (52) is essentially "P"-shaped.

From an operational point of view, in a known way, the arrangement the bituminous tiles (1) for the purpose of making the roof covering is carried out by engagement devices (5) being preferably placed above the separation cut (4) limiting the flaps (3) of the tile body (2). In order to facilitate the correct positioning of the anchoring nails in such a way as to enable an unequivocal identification of the nailing point suitable for allowing the overlying bituminous tile (1) in a laid condition to perform the correct anchorage of the bituminous tile (1) underlying the one to be anchored, the nailing area (51) of each sealing engagement device (5) is positioned on the tile body (2) so as to be placed immediately below the axis joining the first reference wall (251) of the right side (25) and the upper wall (242) of the reference protrusion (241) of the left side (24) of the tile body (2). In any case, as it can also be seen from what is shown for example in FIG. 7, the nailing area (51) of each sealing engagement device (5) is positioned on the tile body (2) in such a way as to be part of what is intended to be the known nailing strip of the bituminous tile (1), wherein by nailing strip one means the area of the tile body (2) within which the nailing has to conveniently occur for the purpose of enabling the reciprocal engagement of the bituminous tile to be nailed to the underlying bituminous tile (1).

The sealing engagement device (5) can be made in such a way that both the shape of the sealing engagement area (52) and the shape of the nailing area (51) may be the most varied provided that they comply with the characteristics that have been described and at least provided that the sealing engagement area (52) constitutes the perimeter of the nailing area (51) and the nailing area (51) itself is positioned on what is intended to be the nailing strip of the bituminous tile (1) which, in the described exemplary embodiment, is placed in the area between the upper wall (242), the lower wall (243), the first reference wall (251) and the second reference wall (252) of the tile body (2). Furthermore, the size of the nailing area arranging the bituminous tiles (1) in such a way that they are aligned in parallel rows, wherein the bituminous tiles (1) of the following row partially overlap those of the previous row. After arranging the first row of bituminous tiles (1) on the covering foundation and after anchoring them to said covering foundation by inserting the anchoring nails placed in correspondence of the nailing area (51) of the sealing engagement devices (5), the arrangement of the second row of bituminous tiles (1) occurs, in a known way, by laying a series of bituminous tiles (1) that partially overlap the bituminous tiles (1) forming said first row. Said bituminous tiles (1) forming the second row are placed in such a way that the upper wall (242) of the reference protrusion (241) of the left side (24) of the tile body (2) and the first reference wall (251) of the right side (25) of the tile body (2) are positioned so as to coincide with the upper longitudinal side (23) of the bituminous tiles (1) of said first row. Furthermore, the bituminous tiles (1) of the second row are positioned in such a way that their flaps (3) are offset with respect to the flaps (3) of the bituminous tiles (1) forming the first row. Because of said positioning of the bituminous tiles (1), as it can also be seen from the example of FIG. 7, the sealing engagement devices (5) of the tiles (1) of the first row will bondingly engage the flaps (3) of the bituminous tiles (1) of the second row, overlying the bituminous tiles of the first row. The bonding engagement of the flaps (3) of the bituminous tiles (1) of the second row on the sealing engagement area (52) of the sealing engagement devices (5) of the bituminous tiles (1) of the first row simultaneously enables the reciprocal engagement of the bituminous tiles (1) and the sealing of the nailing area (51), with the anchoring nail inserted, of the sealing engagement device (5). Considering the above, the sealing engagement devices (5) therefore have the triple function of making immediately visible the optimal positioning area of the anchoring nail, in such a way that it can also unfailingly engage the bituminous tile (1) underlying the one to be anchored; of sealing the insertion area of the anchoring nail by making it watertight as well as of performing the bonding engagement of the bituminous tiles that in a laid condition are overlapped, particularly enabling the anchorage of the flaps (3).

REFERENCE (1) Bituminous tile
(2) tile body
(21) upper face
(22) lower face
(23) upper longitudinal side
(24) left side (241) reference protrusion
(242) upper wall
(243) lower wall
(25) right side
(251) first reference wall
(252) second reference wall
(3) flap
(4) separation cut
(5) sealing engagement device
(51) nailing area
(52) sealing engagement area
(521) first horizontal band
(522) second horizontal band
(523, 524) vertical bands
(525) hollows
(526) upper horizontal band
(527) "U" wall

The invention claimed is:

1. A bituminous tile that defines a positioning area for an anchoring nail, the bituminous tile comprising:

a layered tile body having an upper face and a lower face and a series of flaps arranged in an aligned sequence one alter another corresponding to a lower longitudinal portion of said layered tile body, wherein each flap of the series of flaps is separate from an adjacent flap by way of a separation cut, wherein the upper face of said layered tile body has at least one sealing engagement device, the at least one sealing engagement device having at least one nailing area that univocally identities an insertion area for the anchoring nail, wherein the at least one nailing area is circumscribed by a sealing engagement area, the sealing engagement area being formed of an adhesive or a thermal adhesive or a hot melt material or combinations thereof, wherein the sealing engagement area seats the at least one nailing area while bondingly engaging at least one portion of the bituminous tile, the at least one portion of the bituminous tile at least partially overlapping the sealing engagement device, wherein the at least one nailing area is devoid of a material of which the sealing engagement area is formed.

2. The bituminous tile of claim 1, wherein a size of the at least one nailing area is less than a size of the sealing engagement area.

3. The bituminous tile of claim 1, wherein the sealing engagement device is adapted to overlap an underlying bituminous tile such that the anchoring nail is insertable into the at least one nailing area and also is insertable into a portion of the underlying bituminous tile.

4. The bituminous tile of claim 1, wherein the sealing engagement device is positioned so as to correspond to the separator cut thereabove.

5. The bituminous tile of claim 1, wherein the sealing engagement area at least partially protrudes relative to a plane on which the at least one nailing area lies.

6. The bituminous tile of claim 1, wherein a side of said layered tile body has a reference protrusion, the reference protrusion having an upper wall and a lower wall in parallel relation wherein an opposite side of said layered tile body has a series of recesses so as to define a first reference wall and a second reference wall, the first reference wall being on an axis common with the upper wall of the reference protrusion, the second reference wall being on an axis common with the lower wall of the reference protrusion, wherein the at least one nailing area is positioned on said layered tile body so as to be positioned immediately below the axis common to the first reference wall and the upper wall of the reference protrusion.

7. The bituminous tile of claim 1, wherein a color of the at least one nailing area is different than a color of the sealing engagement area.

8. The bituminous tile of claim 1, wherein the sealing engagement area has at least one horizontal band.

* * * * *